US006634090B2

(12) United States Patent
Koyama et al.

(10) Patent No.: US 6,634,090 B2
(45) Date of Patent: Oct. 21, 2003

(54) METHOD OF PRODUCTION OF SERIES OF A TACTILE CONTACT UNITS AND TACTILE CONTACT UNIT, AND SERIES OF TACTILE CONTACT UNITS AND A TACTILE CONTACT UNIT PRODUCED BY USING THE SAME METHOD

(75) Inventors: Hiromichi Koyama, Okayama (JP); Toyoshi Fukumura, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 127 days.

(21) Appl. No.: 09/832,939

(22) Filed: Jul. 11, 2001

(65) Prior Publication Data

US 2002/0020613 A1 Feb. 21, 2002

(51) Int. Cl.[7] ..... H01H 11/00

(52) U.S. Cl. ..... 29/622; 29/825; 29/842; 29/846; 29/876; 200/515; 200/517

(58) Field of Search ..... 200/515, 517; 29/842, 846, 825, 876, 884, 622; 174/260, 250, 257, 254; 361/749, 750, 751, 781, 680, 683

(56) References Cited

U.S. PATENT DOCUMENTS 4,605,828 A 8/1986 Gostomski, Jr. et al. ..... 200/5
5,357,065 A 10/1994 Mitamura et al. ..... 200/5
5,399,823 A * 3/1995 McCusker ..... 200/521
5,578,802 A * 11/1996 Palmowski ..... 200/5 A
5,845,766 A * 12/1998 Sako et al. ..... 200/516
5,986,228 A * 11/1999 Okamoto et al. ..... 200/516
6,303,888 B1 * 10/2001 Okamoto et al. ..... 200/517

* cited by examiner

*Primary Examiner*—Timothy V. Eley
*Assistant Examiner*—Alvin J Grant
(74) *Attorney, Agent, or Firm*—Wenderoth, Lind & Ponack, L.L.P.

(57) ABSTRACT

A method for production of series of tactile contact units and tactile contact unit for use in manipulating unit of a small-sized electronic device, capable of manufacturing inexpensive tactile contact units by curtailing the process, and series of tactile contact units and tactile contact units manufactured by this method are disclosed. On the upper side of a flexible insulating pad in a form of a roll film, adhesive of a predetermined pattern is printed and adhered at predetermined intervals continuously. Through-holes are disposed at predetermined positions continuously excluding positions the adhesive is printed and adhered on the flexible insulating pad. Further, tactile contacts are fixed continuously in the through-holes.

21 Claims, 7 Drawing Sheets

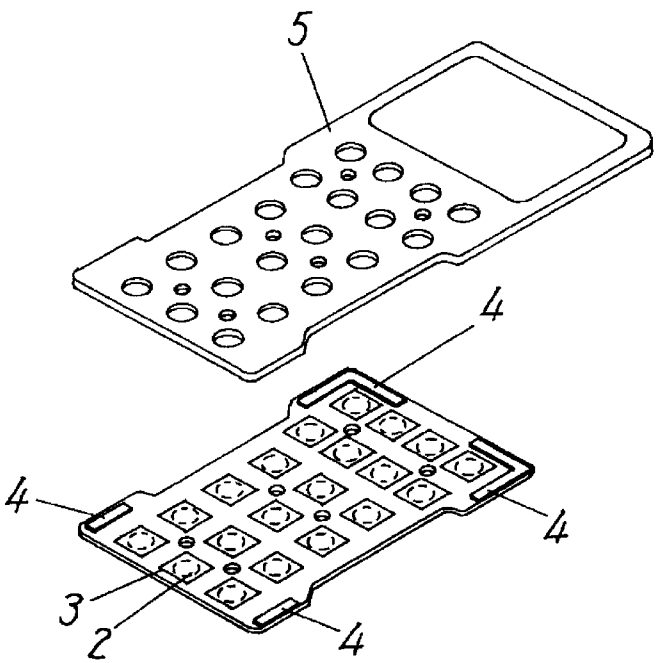
FIG.8 (b) PRIOR ART
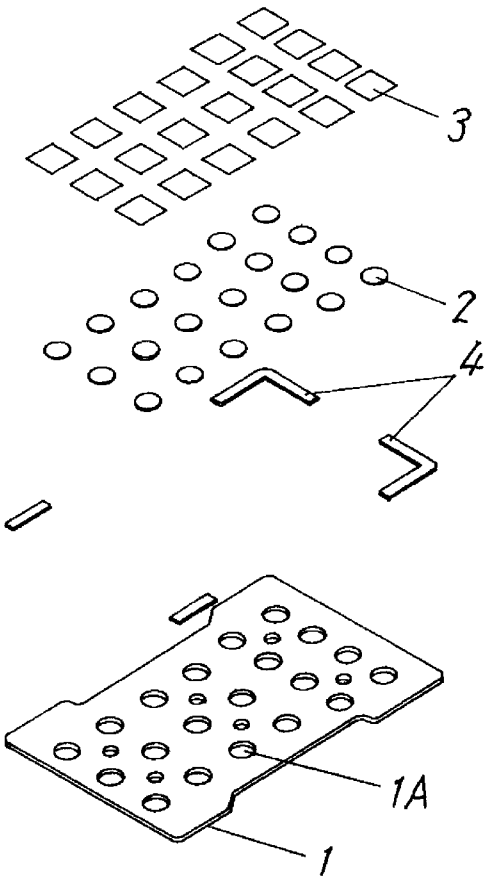
FIG.8 (a) PRIOR ART

METHOD OF PRODUCTION OF SERIES OF A TACTILE CONTACT UNITS AND TACTILE CONTACT UNIT, AND SERIES OF TACTILE CONTACT UNITS AND A TACTILE CONTACT UNIT PRODUCED BY USING THE SAME METHOD

FIELD OF THE INVENTION

The present invention relates to a method for production of s series of tactile contact units formed by continuously disposing a plurality of tactile contact units for push switches used in an operation unit of a small electronic device such as mobile phone and a tactile contact unit, and series of tactile contact units and a tactile contact unit produced by using the same method.

BACKGROUND OF THE INVENTION

A conventional method generally employed for production of a series of tactile contact units is explained by referring to the drawing.

FIG. 8 is a drawing explaining a conventional tactile contact unit and the manner of its use.

In a perspective exploded view shown in FIG. 8(*a*), a thin flexible insulating pad 1 has a plurality of through-holes 1A at push switch positions. Elastic dome-shaped contacts 2 move up and down at the lower side having conductivity through the through-holes 1A. An adhesive tape 3 is adhered to the flexible insulting pad 1 by covering the elastic dome-shaped contacts 2 so as to fix the elastic dome-shaped contacts 2 on the through-holes 1A. One side of a double-sided adhesive tape 4 is adhered to the upper side of the flexible insulating pad 1, and the other side is adhered to the portion to be adhered of the electronic device.

In such a conventional manufacturing method of tactile contact units, the tactile contact units are produced as follows.

i) Through-holes 1A are formed at specified positions of a flexible insulating pad 1.

ii) Elastic dome-shaped contacts 2 are put into the through-holes 1A, covered with an adhesive tape 3, and fixed to the flexible insulating pad 1.

iii) In a later process, a double-sided adhesive tape 4 cut in a specified shape is adhered to specified positions of the flexible insulating pad 1.

A plurality of tactile contact units thus fabricated are arranged on the top of a roll film or the like having a slight adhesiveness, and a series of tactile contact units is formed.

This series of tactile contact units is supplied into the assembly process of electronic device, and individual tactile contact units are removed from the roll film.

Further, as shown in FIG. 8(*b*), the series of tactile contact units is adhered to the portion to be adhered such as transparent panel 5 of electronic device by means of a double-sided adhesive tape 4 on the flexible insulating pad 1.

Thus, the series of tactile contact units is assembled so as to confront the switch contacts (not shown) at the circuit side of the electronic device, and is used as a manipulation unit having push switches.

The conventional manufacturing method of series of tactile contact units involved the following problems.

A double-sided adhesive tape for adhering the series of tactile contact units to the portion to be adhered of the electronic device needs to be processed in a specified shape in another process.

The processed double-sided adhesive tape needs to be adhered to the flexible insulating pad.

Therefore, it requires the die and procedure for processing the double-sided adhesive tape. It also requires the facility and procedure for adhering the double-sided adhesive tape to the flexible insulating pad.

SUMMARY OF THE INVENTION

The present invention addresses the problems discussed above, and it is hence an object of the invention to present a method for inexpensively producing a series of tactile contact units and tactile contact unit by curtailing the manufacturing process, and a series of tactile contact units and a tactile contact unit produced by using the same method.

The method for production of a series of tactile contact units and a tactile contact unit, and a series of tactile contact units and a tactile contact unit produced by using the same method of the invention are characterized by the following An adhesive of specified pattern is printed and adhered at specified intervals on the upper side of a flexible insulating pad.

Through-holes are formed at specified positions excluding the printed and adhered positions of the adhesive, and conductive contacts are continuously fixed on the through-holes.

As a result, the present invention does not require the die and procedure for processing the double-sided adhesive tape, and the facility and procedure for adhering the double-sided adhesive tape to the flexible insulating pad. Therefore, an inexpensive method for producing a series of tactile contact units and a tactile contact unit by curtailing the manufacturing process, and a series of tactile contact units and a tactile contact unit produced by using the same method are obtained.

BRIEF DESCRIPTION OF THE DRAWINGS

FIGS. 8(*a*) and 8(*b*) illustrate a conventional tactile contact unit and the use thereof

DESCRIPTION OF THE PREFERRED EMBODIMENT

An embodiment of the invention is described below while referring to FIG. 1 to FIG. 7.

Embodiment 1

Figure 1:
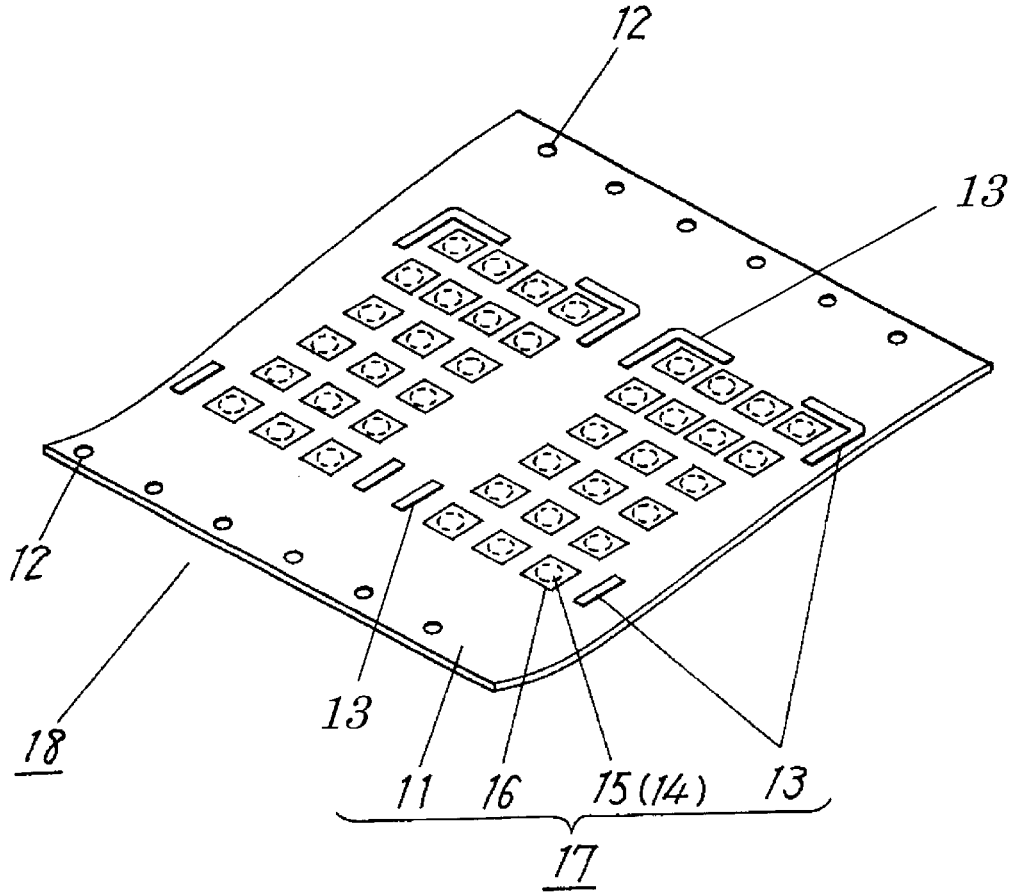
FIG. 1 is an outline perspective view showing a series of tactile contact units manufactured by using a method for production of a series of tactile contact units according to an embodiment of the invention.
Figure 2:
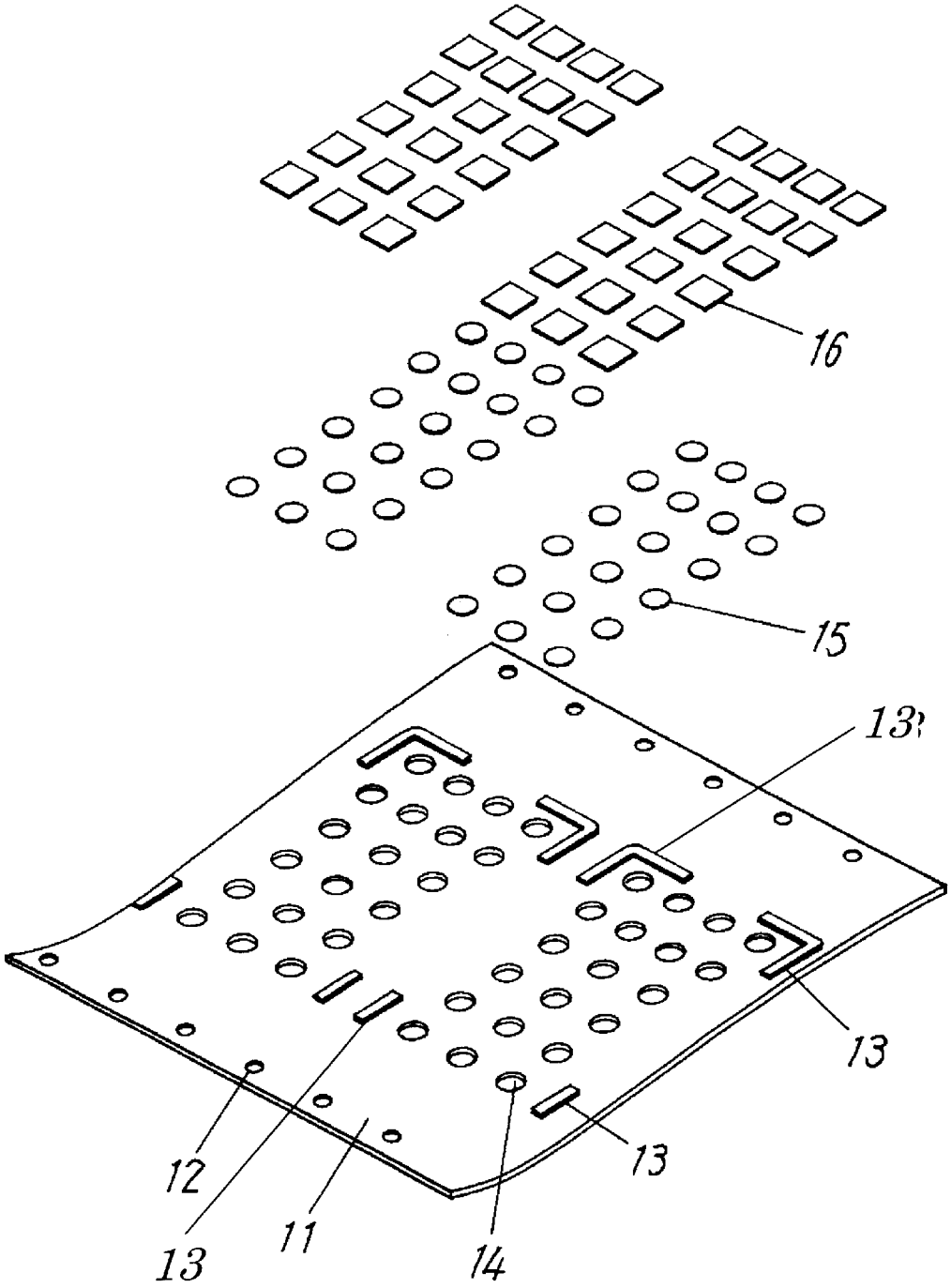
FIG. 2 is a perspective exploded view showing the series of tactile contact units manufactured by using the method for production of a series of tactile contact units according to the embodiment of the invention.

FIG. 1 is an outline perspective view showing a series of tactile contact units manufactured by using a method for production of a series of tactile contact units according to an embodiment of the invention, and FIG. 2 is a perspective exploded view thereof.

In FIG. 1 and FIG. 2, a flat flexible insulating pad 11 is made of a thin pad of polyethylene terephthalate (PET), polypropylene (PP), or polyethylene (PE). Reference holes 12 are provided at predetermined intervals at both sides of this flexible insulating pad 11. The reference holes 12 are used commonly as the reference positions for processing at each processing step. The reference holes 12 are also used as feed holes for conveying the flexible insulating pad 11 on the processing machine according to the processing steps.

A tactile contact unit 17 is composed as follows.

An adhesive 13 is printed and applied on a flexible insulating pad 11 in a predetermined pattern determined according to a position of which the pad will be adhered and fixed to the electronic device.

A plurality of through-holes 14 are disposed at predetermined positions depending on the layout of manipulating parts of the electronic device such as manipulation buttons of a mobile phone.

An elastic dome-shaped contact 15 is composed of a thin metal plate or conductor as a conductive contact accommodated in the plurality of through-holes 14 respectively.

Adhesive tapes 16 are wider than the through-holes 14, and the lower side is adhesive.

The tapes 16 are adhered to the flexible insulating pad 11 so as to cover the elastic dome-shaped contacts 15 accommodated in the through-holes 14.

Thus, a tactile contact unit 17 is composed.

A series of tactile contact units 18 is composed by continuously forming such tactile contact units 17 at predetermined intervals on the flat flexible insulating pad 11.

Figure 3:
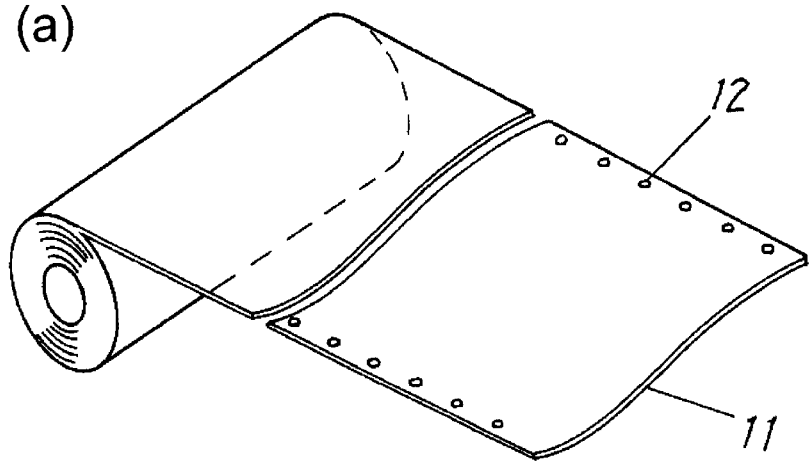
FIGS. 3(*a*) and 3(*b*) illustrate the manufacturing process of a series of tactile contact units according to the embodiment of the invention.
Figure 3:
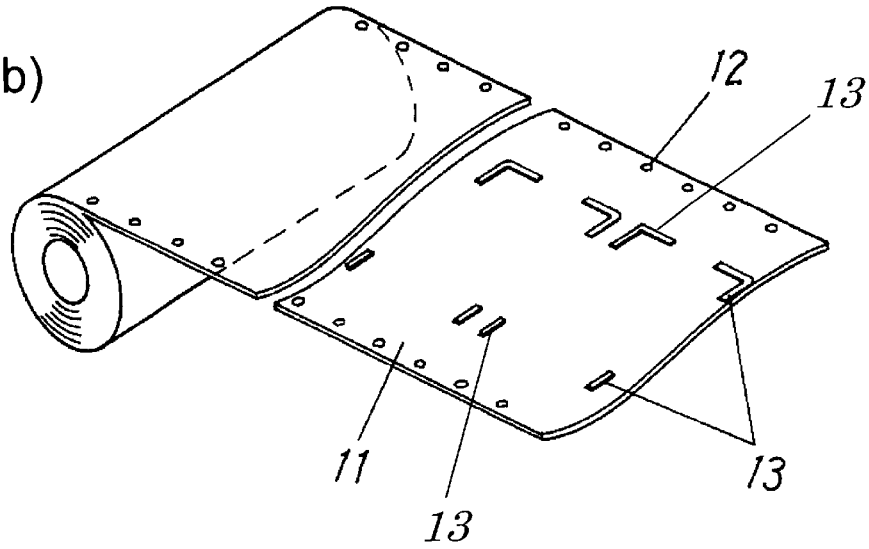
Figure 4:
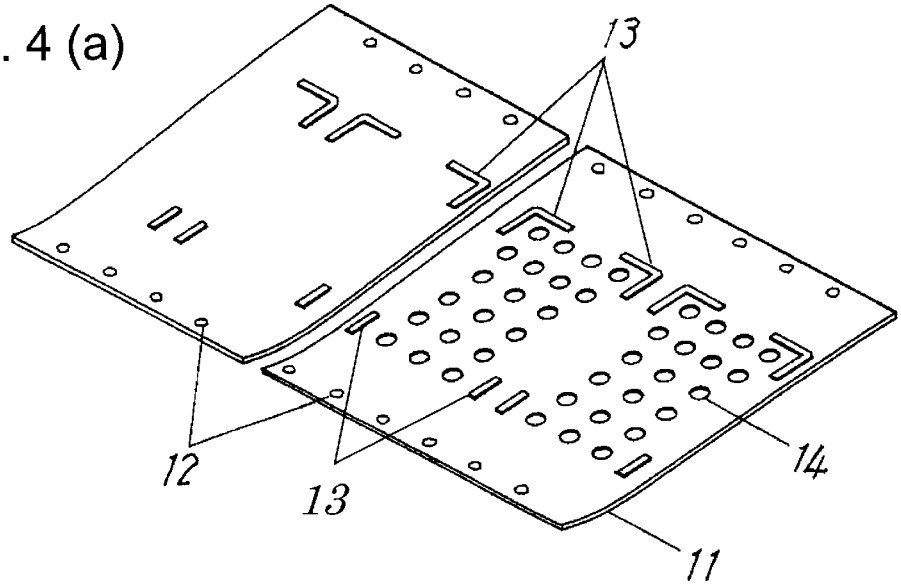
FIGS. 4(*a*) and 4(*b*) illustrate the manufacturing process of a series of tactile contact units according to the embodiment of the invention.
Figure 4:
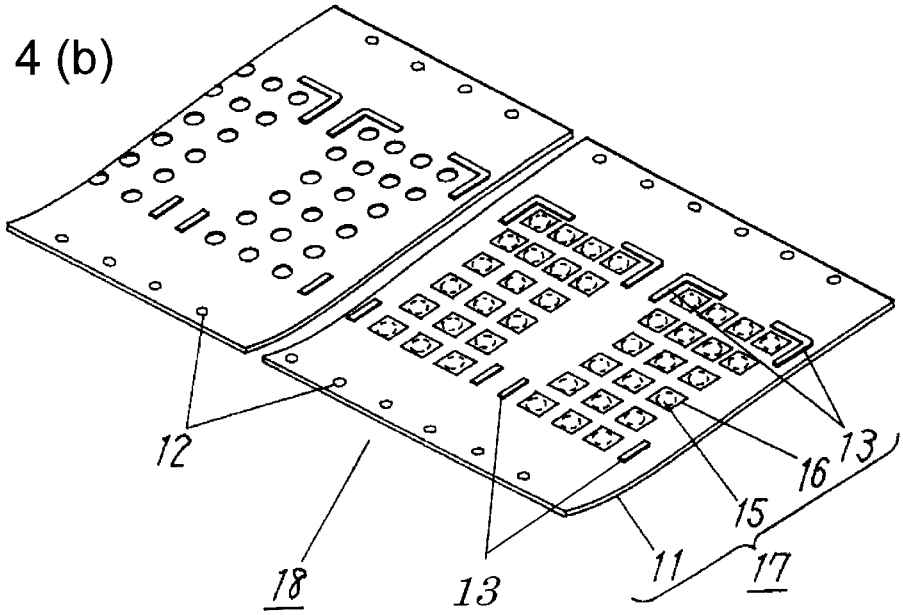
Figure 5:
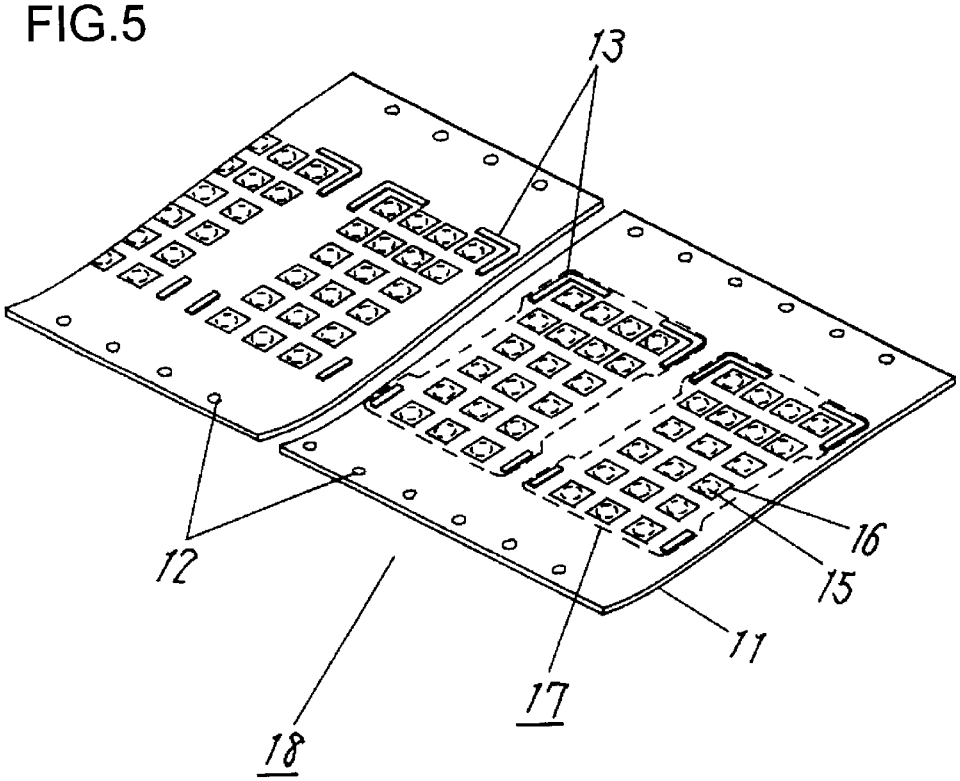
FIG. 5 illustrates the manufacturing process of a series of tactile contact units according to the embodiment of the invention.

A manufacturing method of this series of tactile contact units 18 is explained by referring to the manufacturing process charts in FIG. 3 to FIG. 5.

First, as shown in FIG. 3(*a*), a roll film of flexible insulating pad 11 is punched while being sequentially fed out in a deflection-free state. Further, reference holes 12 of a predetermined size are disposed at both sides at predetermined intervals.

Then, as shown in FIG. 3(*b*), the flexible insulating pad 11 is conveyed to a printing process of adhesive 13. Herein, the flexible insulating pad 11 is positioned by using the reference holes 12.

Next, to form one or plural tactile contact units 17, an adhesive 13 of predetermined pattern is printed continuously at predetermined intervals on the flexible insulating pad 11. Herein, the adhesive 13 is printed by using a metal thin plate mask, a silk screen or a transferring pattern for printing.

As shown in FIG. 4(*a*), in the same way as above, the flexible insulating pad 11 is positioned by using the reference holes 12.

Further, through-holes 14 are formed by punching for accommodating elastic dome-shaped contacts 15 at predetermined positions corresponding to the manipulation units of the electronic device.

Next, as shown in FIG. 4(*b*), the elastic dome-shaped contacts 15 are incorporated in the through-holes 14. Herein, the diameter of the through-holes is slightly larger than the outside diameter of the elastic dome-shaped contacts.

Moreover, adhesive tapes 16 are pressed on and adhered to the elastic dome-shaped contacts, and the elastic dome-shaped contacts 15 are fixed to the flexible insulating pad 11.

Thus, individual tactile contact units 17 are formed continuously at specified intervals, and a series of tactile contact units 18 is formed on the flat flexible insulating pad 11.

The series of tactile contact units 18 thus formed is directly supplied into the assembling process of electronic device.

Herein, as shown by broken line in FIG. 5, the outline of the tactile contact unit 17 is cut out by punching or other processes.

After that, the tactile contact unit 17 is adhered and fixed to the portion to be adhered of the electronic device by the adhesive 13 so that the elastic dome-shaped contacts 15 may confront the switch contacts provided at the circuit side of the electronic device.

The elastic dome-shaped contact 15 is, when depressed, inverted in the dome-shaped contact and conducts with the contact at the circuit side of the electronic device disposed beneath. When released, the dome-shaped contact returns to the original state by the own repulsive force. Accordingly, the self-resetting switch is composed easily as explained above.

Thus the tactile contact units 17 form the manipulating unit of the electronic device.

In this manufacturing method explained above, the series of tactile contact units disposing the tactile contact units continuously at predetermined intervals is supplied in the assembling process of the electronic device. The individual tactile contact units are cut out in a predetermined outline, and adhered to the portion to be adhered of the electronic device. Therefore, a series of assemblies can be done continuously, and this manufacturing method is easy and efficient in assembling.

The series of tactile contact units 18 may be also supplied in the assembling process of the electronic device in the following procedure.

After completion of the series of tactile contact units 18, it is once cut into strips having a specific number of tactile contact units 17, or the continuous series is once taken up into a roll and stored, and supplied in the assembling process of the electronic device as required.

Alternatively, after completion of the series of tactile contact units 18, the individual tactile contact units 17 are cut out and stored, and supplied in the assembling process of the electronic device as required.

As in these examples, when the individual tactile contact units are cut out from the series of tactile contact units before the assembling process of the electronic device, the tactile contact units 17 may be arranged on a relatively wide film or surface treated paper by using the adhesive, and fixed provisionally. Thus, it is easier to handle the tactile contact units 17 in storing and transportation.

Thus, according to the embodiment, i) Using the same reference holes as position reference, the adhesive 13 is continuously printed on the roll film of the flexible insulating pad 11, ii) Through-holes 14 are formed by punching continuously, and iii) Elastic dome-shaped contacts 15 are able to be fixed continuously.

Therefore, each processing position can be precisely adjusted, and fluctuations in operation of the manipulating unit of the electronic device can be minimized. At the same time, the adhesive 13 can be continuously printed and adhered onto the flexible insulating pad 11. Thus, the manufacturing process is curtailed, and an inexpensive series of tactile contact units 18 can be obtained.

Further, by putting the elastic dome-shaped contacts 15 in the through-holes 14, the mounting position is able to be highly precise, and the total thickness of the tactile contact units 17 can be reduced.

In this explanation, the adhesive is printed and adhered to the flexible insulating pad, and elastic dome-shaped contacts are put in the through-holes.

Figure 6:
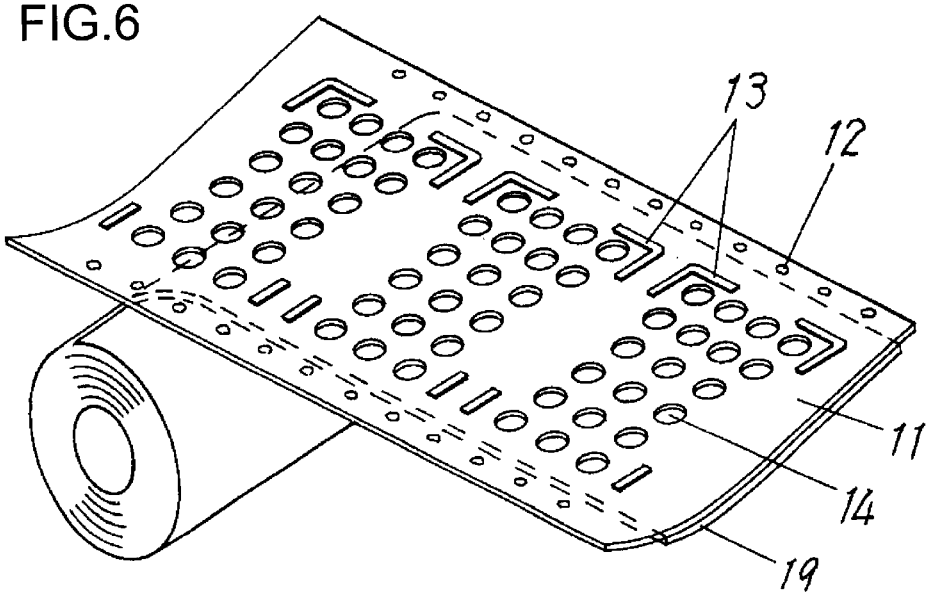
FIG. 6 illustrates a manufacturing process of adhering a surface protective film to the lower side of flexible insulating pad.

The series of tactile contact units can be also manufactured in the following method as shown in the explanatory figure of manufacturing process for adhering a surface protective film to the lower side of the flexible insulating pad in FIG. 6.

i) Adhesive 13 is printed and adhered to the upper side of the flexible insulating pad 11.

ii) Through-holes 14 are formed by punching.

iii) After that, surface protective film 19 of narrower width than the width of the flexible insulating pad 11 is continuously adhered to the lower side of the flexible insulating pad 11 so as to expose reference holes 12 at both sides.

iv) The surface protective film 19 is removed just before adhering and fixing the tactile contact units to the portion to be adhered of the electronic device.

Thus, after the elastic dome-shaped contacts are installed and the series of tactile contact units is completed, the surface protective film 19 protects the contact surface of the elastic dome-shaped contacts. It is thus possible to suppress deterioration of electric contact performance of contact surface due to humidity or floating dust of the surrounding environments. Therefore, the reliability of push switches of the manipulating unit of the electronic device can be enhanced.

In other words, the surface protective film at the lower side of the flexible insulating pad covers the contact surface of the tactile contacts, and deterioration of reliability of tactile contacts due to deposit of dust on the contact surface can be suppressed.

Figure 7:
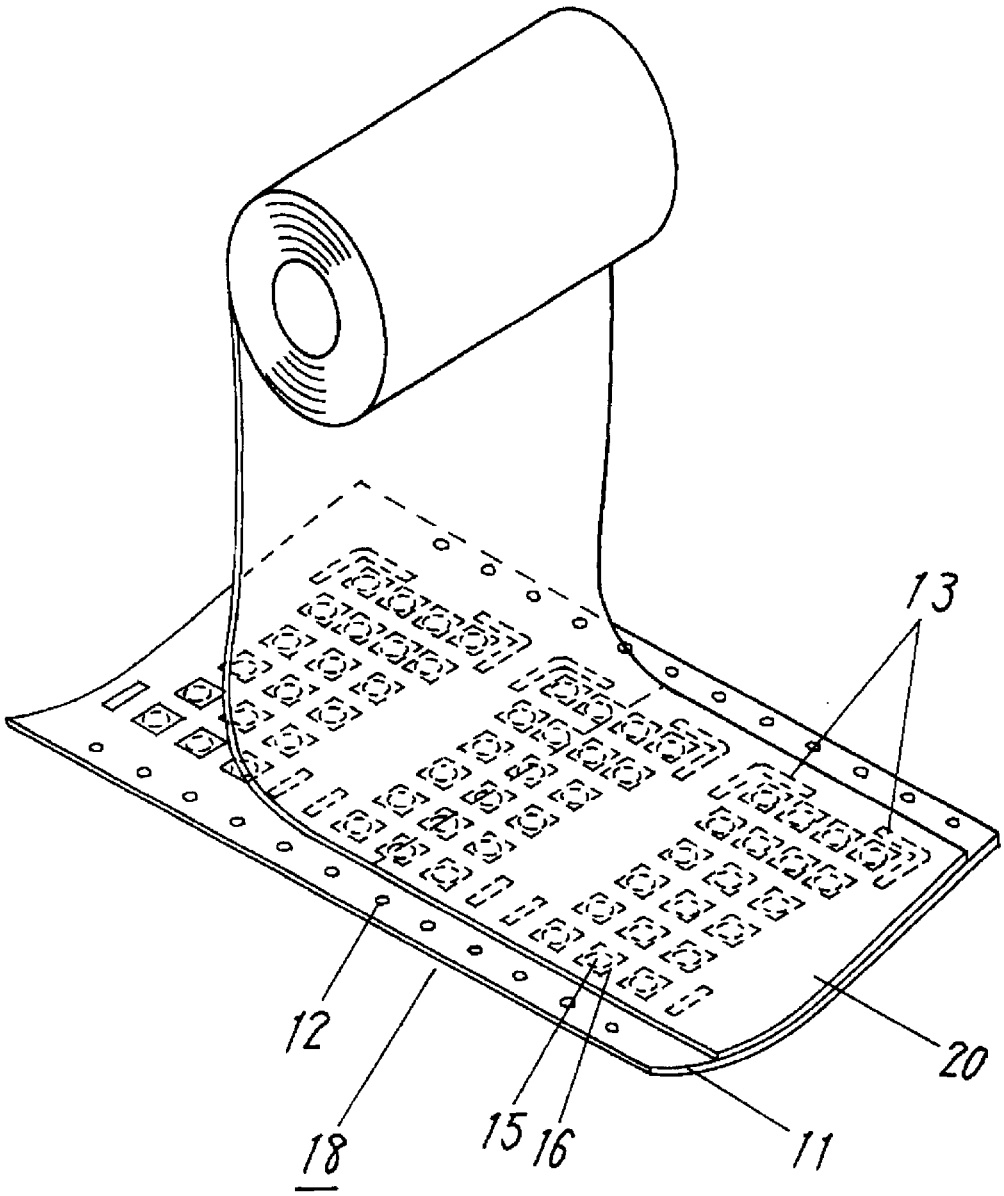
FIG. 7 illustrates a manufacturing process of adhering a surface protective film to the upper side of flexible insulating pad.

The series of tactile contact units can be also manufactured in the following method as shown in the explanatory diagram of manufacturing process for adhering a surface protective film to the upper side of the flexible insulating pad in FIG. 7.

A surface protective film 20 of narrower width than the width of the flexible insulating pad 11 is continuously adhered to the upper side of the flexible insulating pad 11 so as to expose reference holes 12 at both sides.

It is removed just before adhering and fixing the tactile contact units 17 to the portion to be adhered of the electronic device.

Thus, the surface protective film 20 covers the surface of the adhesive 13, and hence protects the adhesive 13. Therefore, until the tactile contact units 17 are adhered and fixed to the portion to be adhered of the electronic device, deterioration of adhesiveness of the adhesive 13 can be suppressed.

Further, both upper surface and lower surface of the series of tactile contact units 18 may be covered with surface protective films 19 and 20. In this case, as explained in the two cases above, while maintaining the reliability of the contact surface of the tactile contacts, deterioration of adhesiveness of the adhesive can be suppressed.

Thus, according to the invention, using the same reference holes as position reference, the adhesive can be continuously printed on the roll film of the flexible insulating pad, through-holes can be processed, and tactile contacts can be mounted. Therefore, each processing position can be precisely adjusted, and fluctuations in operation of the manipulating unit of the electronic device can be minimized.

At the same time, the adhesive can be continuously printed and adhered onto the flexible insulating pad.

Therefore, a method for production of inexpensive series of tactile contact units and tactile contact unit by curtailing the manufacturing process, and series of tactile contact units and tactile contact unit produced by using the same method are presented.

What is claimed is:

1. A method of producing a series of tactile contact units including a tactile contact unit having a tactile contact disposed in a through-hole of a flexible insulating pad, said method comprising:

providing a plurality of reference holes, spaced at a first interval, at a side of a flexible insulating pad;

printing and adhering a plurality of adhesive patterns, spaced at a second interval based on the reference holes on an upper side of the flexible insulating pad;

providing a through-hole in the flexible insulating pad at a location, based on the reference holes, that is not a location that is common with a location of the adhesive; and arranging a tactile contact in the through-hole.

2. The method of producing a series of tactile contact units of claim 1, further comprising conveying the flexible insulating pad by using the reference holes as feed holes.

3. The method of producing a series of tactile contact units of claim 1, wherein said arranging the tactile contact comprises arranging an elastic dome-shaped contact.

4. The method of producing series of tactile contact units of claim 3, further comprising:

fixing the dome-shaped contact to the flexible insulating pad via an adhesive tape, wherein said providing a through-hole comprises providing a through hole having a diameter that is larger than an outside diameter of the elastic dome-shaped contact.

5. The method of producing a series of tactile contact units of claim 1, further comprising adhering a surface protective film to at least one of an upper surface and a lower surface of the flexible insulating pad.

6. The method of producing a series of tactile contact units of claim 1, wherein the flexible insulating pad comprises an un-rollable roll of film, and wherein said providing a plurality of references comprises providing a plurality of reference holes while the un-rollable roll of flexible insulating pad is unrolled.

7. A series of tactile contact units comprising:

a flexible insulating pad having a side, a through-hole and a plurality of reference holes spaced at first intervals at the side;

a tactile contact disposed in the through-hole; and adhesive patterns printed, adhered, and spaced at second predetermined intervals, based on the reference holes, on an upper side of said flexible insulating pad, wherein the through-hole is disposed at a position, based on the reference holes, excluding positions at which said adhesive patterns are printed and adhered on said flexible insulating pad.

8. The series of tactile contact units of claim 7, wherein said flexible insulating pad is operable to be conveyed by using said reference holes as feed holes.

9. The series for production of series of tactile contact units of claim 7, wherein said tactile contact comprises an elastic dome-shaped contact.

10. The series of tactile contact units of claim 9, further comprising:

an adhesive tape, wherein a diameter of the through-hole is larger than an outside diameter of said elastic dome-shaped contact, and wherein said elastic dome-shaped contact is fixed to said flexible insulating pad via said adhesive tape.

11. The series of tactile contact units of claim 7, further comprising a surface protective film adhered to at least one of the upper surface and a lower surface of said flexible insulating pad.

12. A method of producing a tactile contact unit with a tactile contact disposed in a through-hole formed in a flexible insulating pad, said method comprising:

providing a plurality of reference holes spaced at a first interval at a side of the flexible insulating pad;

printing and adhering adhesive patterns spaced at a second interval, based on the reference holes, on an upper surface of the flexible insulating pad;

providing the through-hole at a position, based on the reference holes, excluding a position at which the adhesive is printed and adhered on the flexible insulating pad;

disposing the tactile contact in the through-hole; and separating the flexible insulating pad by cutting out a predetermined outlined shape.

13. The method of producing a tactile contact unit of claim 12, further comprising conveying the flexible insulating pad by using the reference holes as feed holes.

14. The method for production of tactile contact unit of claim 12, wherein said disposing the tactile contact comprises disposing an elastic dome-shaped contact.

15. The method of producing a tactile contact unit of claim 14, further comprising:

fixing the elastic dome-shaped contact to the flexible insulating pad via an adhesive tape, wherein the diameter of the through-hole is larger than an outside diameter of the elastic dome-shaped contact.

16. The method for production of tactile contact unit of claim 12, further comprising adhering a surface protective film to at least one of the upper side and a lower side of the flexible insulating pad after either said providing the through-hole or said disposing the tactile contact.

17. The method of producing a series of tactile contact units of claim 12, wherein the flexible insulating pad comprises an un-rollable role of film, and wherein said providing a plurality of reference holes comprises providing a plurality of reference holes while the flexible insulating pad is unrolled.

18. A tactile contact unit comprising:

a flexible insulating pad having a side, a through-hole and a plurality of reference holes spaced at first intervals at the side;

a tactile contact disposed in the through-hole; and adhesive pattern printed and adhered, based on the reference holes, on an upper side of said flexible insulating pad, wherein the through-hole is disposed at a position, based on the reference holes, excluding a position at which said adhesive pattern is printed and adhered on said flexible insulating pad.

19. The tactile contact unit of claim 18, wherein said tactile contact comprises an elastic dome-shaped contact.

20. The series of tactile contact units of claim 19, further comprising:

an adhesive tape, wherein a diameter of the through-hole is larger than an outside diameter of said elastic dome-shaped contact, and wherein said elastic dome-shaped contact is fixed to said flexible insulating pad via said adhesive tape.

21. The tactile contact unit of claim 18, further comprising a surface protective film adhered to at least one of the upper surface and a lower surface of said tactile contact unit.

* * * * *

UNITED STATES PATENT AND TRADEMARK OFFICE

CERTIFICATE OF CORRECTION

PATENT NO. : 6,634,090 B2
DATED : October 21, 2003
INVENTOR(S) : Hiromichi Koyama et al.

It is certified that error appears in the above-identified patent and that said Letters Patent is hereby corrected as shown below:

Title page,
Item [57], ABSTRACT, please replace "production of series of" with -- producing a series of --.; please replace "a tactile contact units and tactile" with -- tactile contact units and a tactile --.; please replace "and series of" with -- and a series of --.

Signed and Sealed this

Twenty-first Day of September, 2004

JON W. DUDAS
*Director of the United States Patent and Trademark Office*